US009249554B2

(12) United States Patent
Colwell et al.

(10) Patent No.: US 9,249,554 B2
(45) Date of Patent: Feb. 2, 2016

(54) DIPPER BAIL

(71) Applicant: Harnischfeger Technologies, Inc., Wilmington, DE (US)

(72) Inventors: Joseph J. Colwell, Hubertus, WI (US); Matthew I. Loew, Oconomowoc, WI (US); Richard Nicoson, Hartford, WI (US); Nicholas R. Voelz, Jackson, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 512 days.

(21) Appl. No.: 13/691,024

(22) Filed: Nov. 30, 2012

(65) Prior Publication Data

US 2013/0136570 A1 May 30, 2013

Related U.S. Application Data

(60) Provisional application No. 61/565,291, filed on Nov. 30, 2011.

(51) Int. Cl.

| | |
|---|---|
| ***E02F 9/14*** | (2006.01) |
| ***E02F 3/40*** | (2006.01) |
| ***E02F 3/30*** | (2006.01) |
| ***E02F 3/60*** | (2006.01) |
| *B66C 23/82* | (2006.01) |
| *E02F 3/58* | (2006.01) |

(52) U.S. Cl.

CPC . *E02F 3/40* (2013.01); *E02F 3/308* (2013.01); *E02F 3/60* (2013.01); *B66C 23/82* (2013.01); *E02F 3/58* (2013.01); *E02F 9/14* (2013.01)

(58) Field of Classification Search

CPC ..... E02F 3/30; E02F 3/308; E02F 3/40; E02F 3/427; E02F 3/47; E02F 3/54; E02F 3/58; E02F 3/60; E02F 9/006; E02F 9/14; F16N 11/04

USPC ..... 37/394, 395, 396, 397, 398, 399; 184/45.1; 384/322, 369, 373, 374, 375, 384/380, 381, 385, 388, 392; 414/690, 693, 414/694, 723, 726

See application file for complete search history.

(56) References Cited

U.S. PATENT DOCUMENTS

| | | | | |
|---|---|---|---|---|
| 671,014 A * | 4/1901 | Council | 384/381 |
| 1,008,247 A | 11/1911 | Dowd | |
| 1,594,508 A | 8/1926 | Rorabeck | |
| 1,609,372 A | 12/1926 | Lichtenberg | |
| 1,766,343 A | 6/1930 | McNinch | |
| 1,832,493 A * | 11/1931 | Marsilius | 384/13 |
| 2,034,854 A | 3/1936 | Younie | |

(Continued)

OTHER PUBLICATIONS

First Office Action from the Australian Patent Office for Application No. 2012258456 dated Apr. 1, 2014 (6 pages).

(Continued)

*Primary Examiner* — Ernesto Suarez
*Assistant Examiner* — Brendan Tighe
(74) *Attorney, Agent, or Firm* — Michael Best & Friedrich LLP

(57) ABSTRACT

The invention provides a bail for a rope shovel having a hoist rope and a dipper. The bail includes a pair of arms coupled to the dipper; and a cross-member extending between the pair of arms and being pivotably coupled to each of the arms. The cross-member includes a mounting block for coupling the hoist rope to the bail.

28 Claims, 12 Drawing Sheets

(56) References Cited

U.S. PATENT DOCUMENTS

| | | | | |
|---|---|---|---|---|
| 2,109,195 | A | 2/1938 | Green | |
| 2,403,397 | A | 7/1946 | Rankin | |
| 2,947,430 | A | 8/1960 | Schneider | |
| 3,608,755 | A | 9/1971 | Solokhin et al. | |
| 3,877,581 | A | 4/1975 | Auxer | |
| 3,915,238 | A | 10/1975 | Hubbell | |
| 3,933,260 | A | 1/1976 | Kronlokken et al. | |
| 4,150,812 | A | 4/1979 | Baron | |
| 4,329,794 | A * | 5/1982 | Rogers | 37/398 |
| 4,597,713 | A | 7/1986 | Briscoe et al. | |
| 5,657,559 | A | 8/1997 | Immel | |
| 6,209,234 | B1 | 4/2001 | Meyers | |
| 2009/0136291 | A1 | 5/2009 | McClanahan et al. | |
| 2010/0072156 | A1 | 3/2010 | Mentink et al. | |
| 2014/0090279 | A1 * | 4/2014 | Campbell | 37/399 |

OTHER PUBLICATIONS

Mexican Patent Office Action for Application No. MX/a/2012/014022 dated Oct. 9, 2014 (4 pages, English translation only).

Dipper Assembly for P&H Mining Shovel Model 2800 (DWG # 100J3356), available since Feb. 13, 1977 (4 pages).

* cited by examiner

DIPPER BAIL

CROSS-REFERENCE TO RELATED APPLICATIONS

This application claims the benefit of U.S. Provisional Patent Application No. 61/565,291, filed Nov. 30, 2011, the entire contents of which are incorporated herein by reference.

BACKGROUND OF THE INVENTION

The present invention relates to the field of mining shovels. Specifically, the present invention discloses a bail for a shovel dipper.

Conventional mining shovels include a boom, a dipper handle coupled to the boom, and a dipper coupled to an end of the dipper handle. The dipper is moved during a dig cycle by a rope that passes over a boom sheave coupled to the end of the boom. The rope is attached to a bail and/or an equalizer, which are coupled to the dipper. The bail and the equalizer can be used separately or in combination. A bail provides a rigid connection between the rope and dipper and maintains clearance between the rope and the dipper. The bail increases the dig force by applying the rope force closer to the digging lip. An equalizer maintains the ropes in a position that is tangent to the boom sheave and increases the dig and dump heights of the dipper.

However, conventional bails and equalizers directly attached to the dipper each have disadvantages: the bail reduces the dig and dump heights of the dipper, and the equalizer reduces the cutting force. Although combining the components into the same assembly balances these factors and improves the cutting force, the combination increases the length of the components between the rope and the dipper and results in reduced dig and dump heights.

SUMMARY OF THE INVENTION

In one embodiment, the invention provides a bail for a rope shovel having a hoist rope and a dipper. The bail includes a pair of arms coupled to the dipper and a cross-member extending between the pair of arms and pivotably coupled to each of the arms. The cross-member includes a mounting block for coupling the hoist rope to the bail.

In another embodiment, the invention provides a dipper assembly for a rope shovel having a hoist rope extending over a boom and coupled to the dipper assembly to raise and lower the dipper assembly. The dipper assembly includes a dipper body, a pair of arms coupled to opposing sides of the dipper body, and a cross-member. The dipper body defines a material receiving end and a material discharging end. The dipper body includes a dipper door pivotably coupled to the dipper body and positioned proximate the material discharging end to selectively close the material discharging end. Each arm includes a first end coupled to the dipper body and a second end. The cross-member is pivotably coupled to the second end of each arm and includes a mounting block for receiving the hoist rope.

In yet another embodiment, the invention provides a bail for a rope shovel having a hoist rope extending over a boom and a dipper. The bail includes a first arm, a second arm, and a mounting block. The first arm includes a first end and a second end. The first end is pivotably coupled to the dipper. The second arm is substantially parallel to the first arm and includes a first end and a second end. The first end is pivotably coupled to the dipper. The mounting block is positioned between the second end of first arm and the second end of the second arm and is substantially pivotable about an axis. The mounting block intersects the axis.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
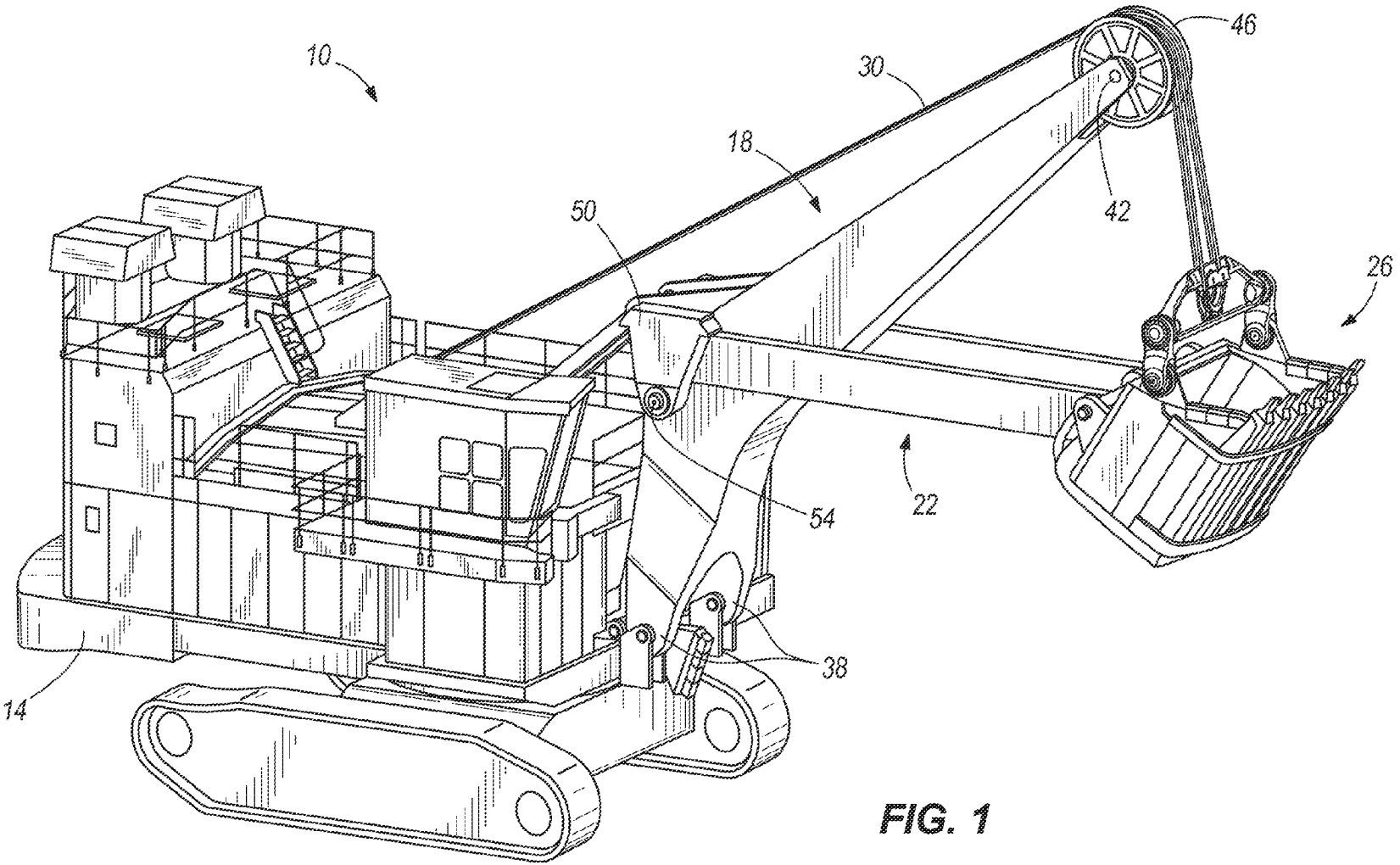
FIG. 1 is a perspective view of a mining shovel.
Figure 2:
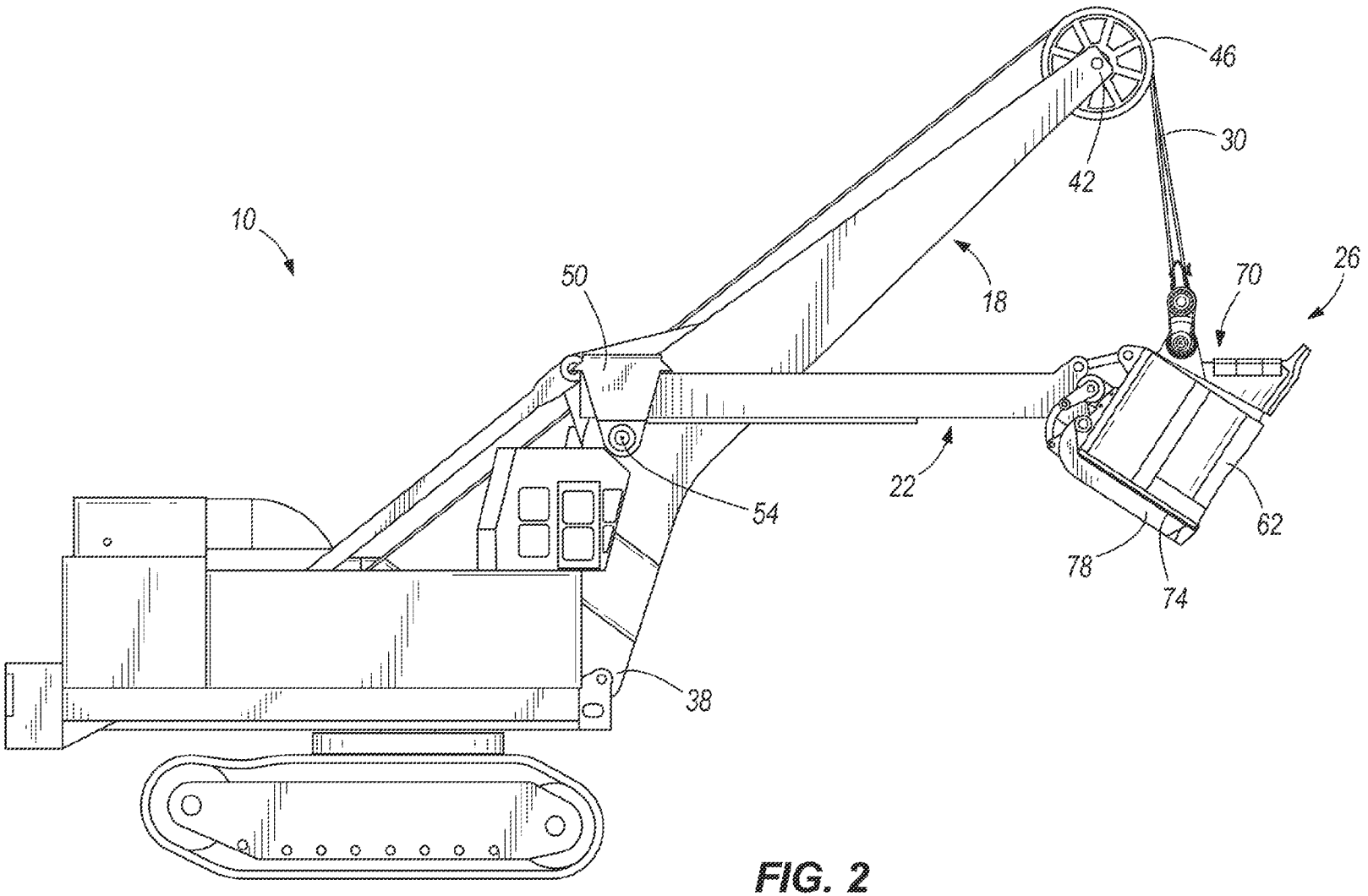
FIG. 2 is a side view of the mining shovel of FIG. 1.

As shown in FIGS. 1 and 2, a mining shovel 10 includes a base 14, a boom 18, a handle 22, and a dipper assembly 26. The base 14 includes a hoist drum (not shown) for reeling in and paying out a cable or hoist rope 30. The boom 18 includes a first end 38 coupled to the base 14, a second end 42 opposite the first end 38, a boom sheave 46 coupled to the second end 42, a saddle block 50, and a shipper shaft 54. The boom sheave 46 guides the hoist rope 30 over the second end 42 of the boom 18 to support the dipper assembly 26. The dipper assembly 26 is raised or lowered as the hoist rope 30 is reeled in or paid out by the hoist drum. The saddle block 50 is pivotably coupled to the boom 18 by the shipper shaft 54. The handle 22 is movably received in the saddle block 50, and the handle 22 passes through the saddle block 50. The handle 22 is therefore configured for rotational movement relative to the boom 18 due to the rotation of the saddle block 50, and the handle 22 is configured for translational movement relative to the boom 18 due to the sliding connection between the handle 22 and the saddle block 50. The handle 22 is also coupled to the dipper assembly 26.

Figure 3:
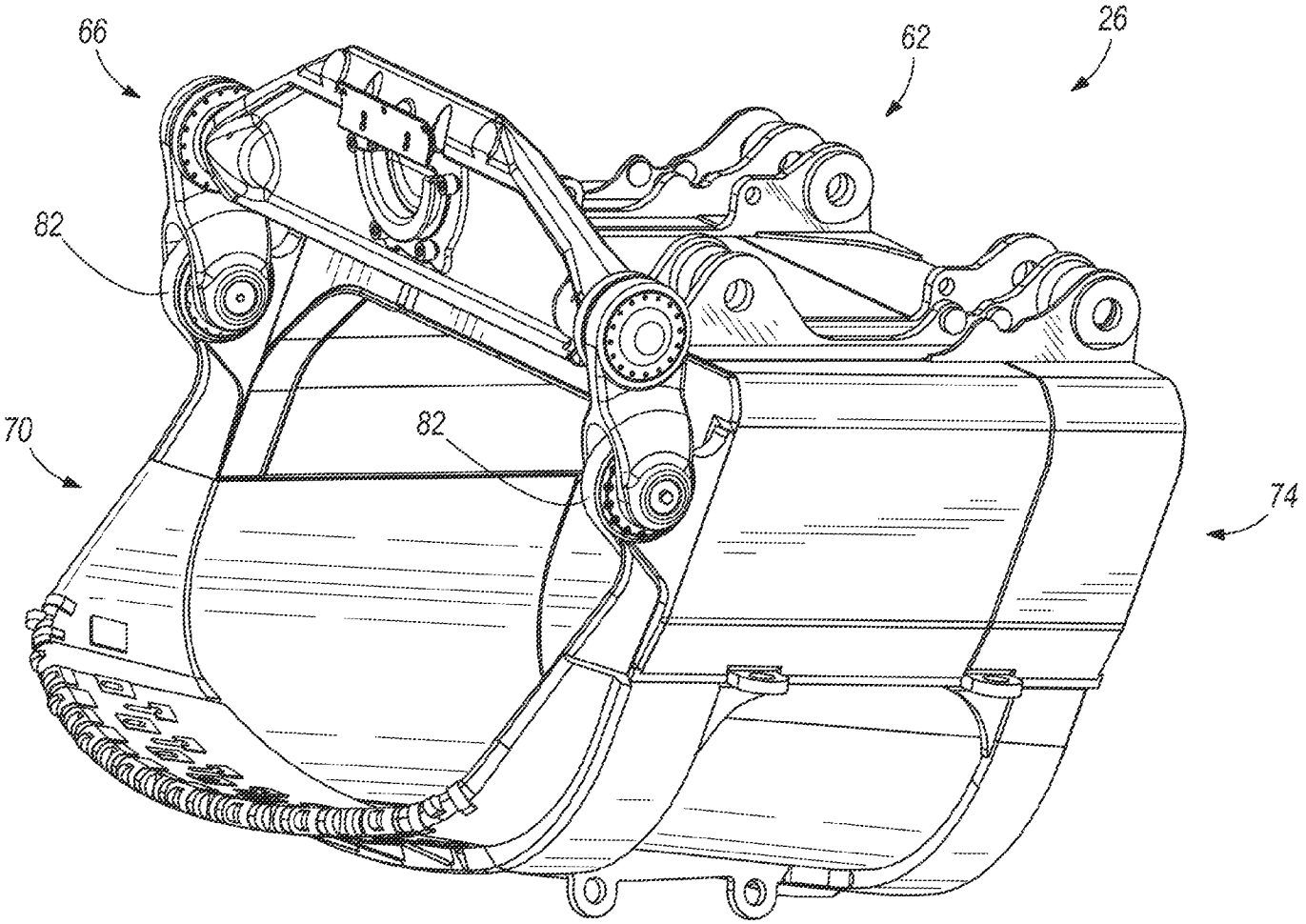
FIG. 3 is a perspective view of a dipper body and bail.
Figure 4:
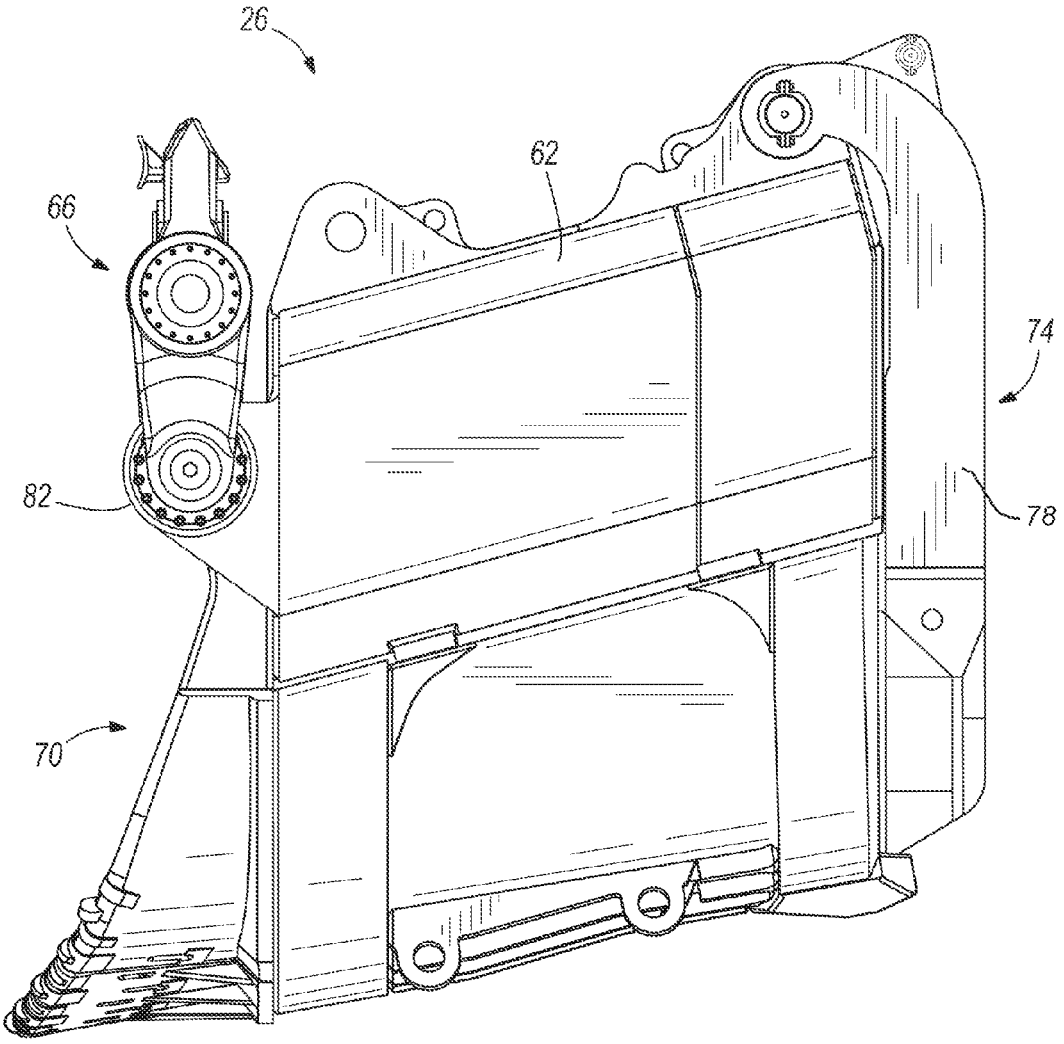
FIG. 4 is a side view of the dipper body and bail of FIG. 3.

Referring to FIGS. 3 and 4, the dipper assembly 26 includes a dipper body 62 and a bail 66. The dipper body 62 defines a material receiving end 70 and a material discharging end 74 and includes a dipper door 78 (FIG. 4) and trunnions 82. The dipper door 78 is pivotably coupled to the dipper body 62 to selectively close the material discharging end 74. The bail 66 is pivotably coupled to the trunnions 82 and receives the rope 30 (FIG. 2) that passes over the boom sheave 46. In the illustrated embodiment, the trunnions 82 are positioned on opposing sides of the dipper body 62 proximate the material receiving end 70.

Figure 5:
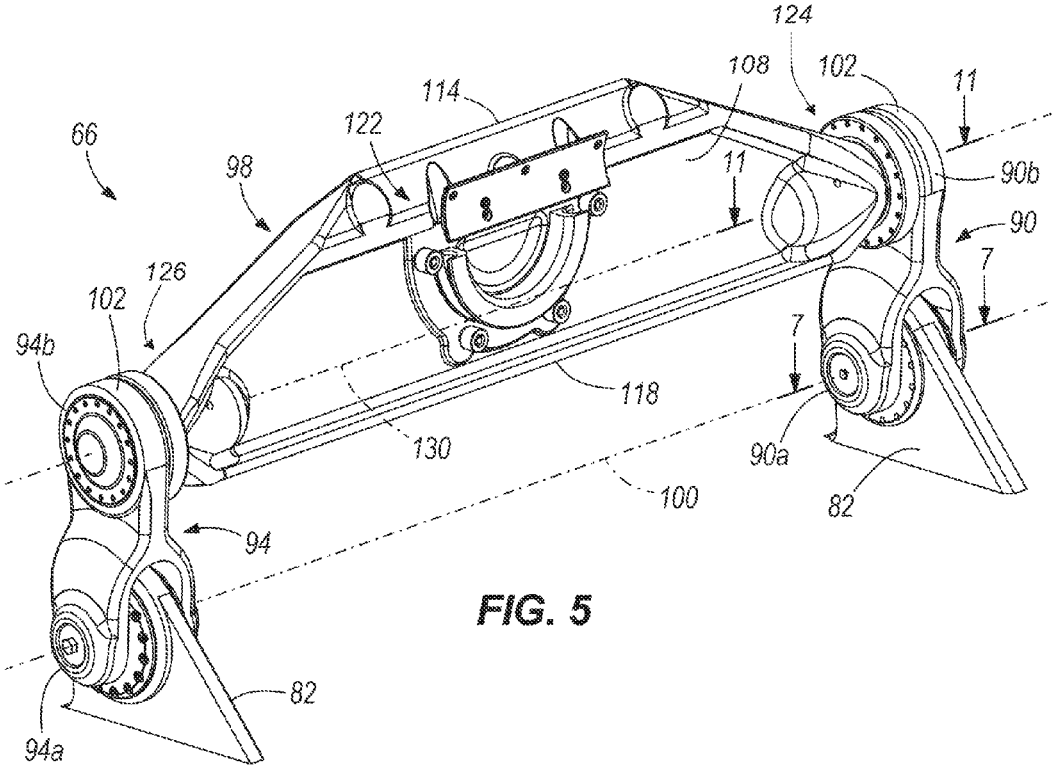
FIG. 5 is a front perspective view of a bail.
Figure 6:
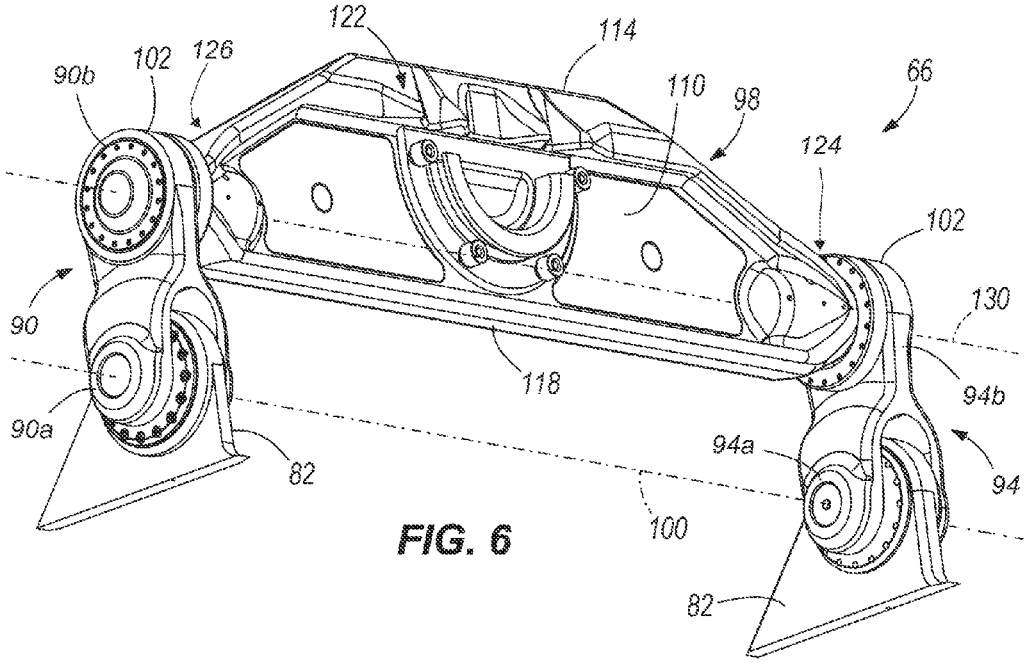
FIG. 6 is a rear perspective view of the bail of FIG. 5.

As shown in FIGS. 5 and 6, the bail 66 includes a first arm 90, a second arm 94, and a cross-member 98. The first arm 90 includes a first end 90*a* and a second end 90*b*. The second arm 94 includes a first end 94*a* and a second end 94*b*. In the illustrated embodiment, the first ends 90*a*, 94*a* are substantially pivotable about a common arm axis 100. In addition, the second ends 90*b*, 94*b* of the arms 90, 94 define a pair of shoulders 102. The first arm 90 and the second arm 94 may be replaced with arms of various lengths in order to optimize the dump height and the digging clearance between the cross-member 98 and the dipper assembly 26.

Figure 7:
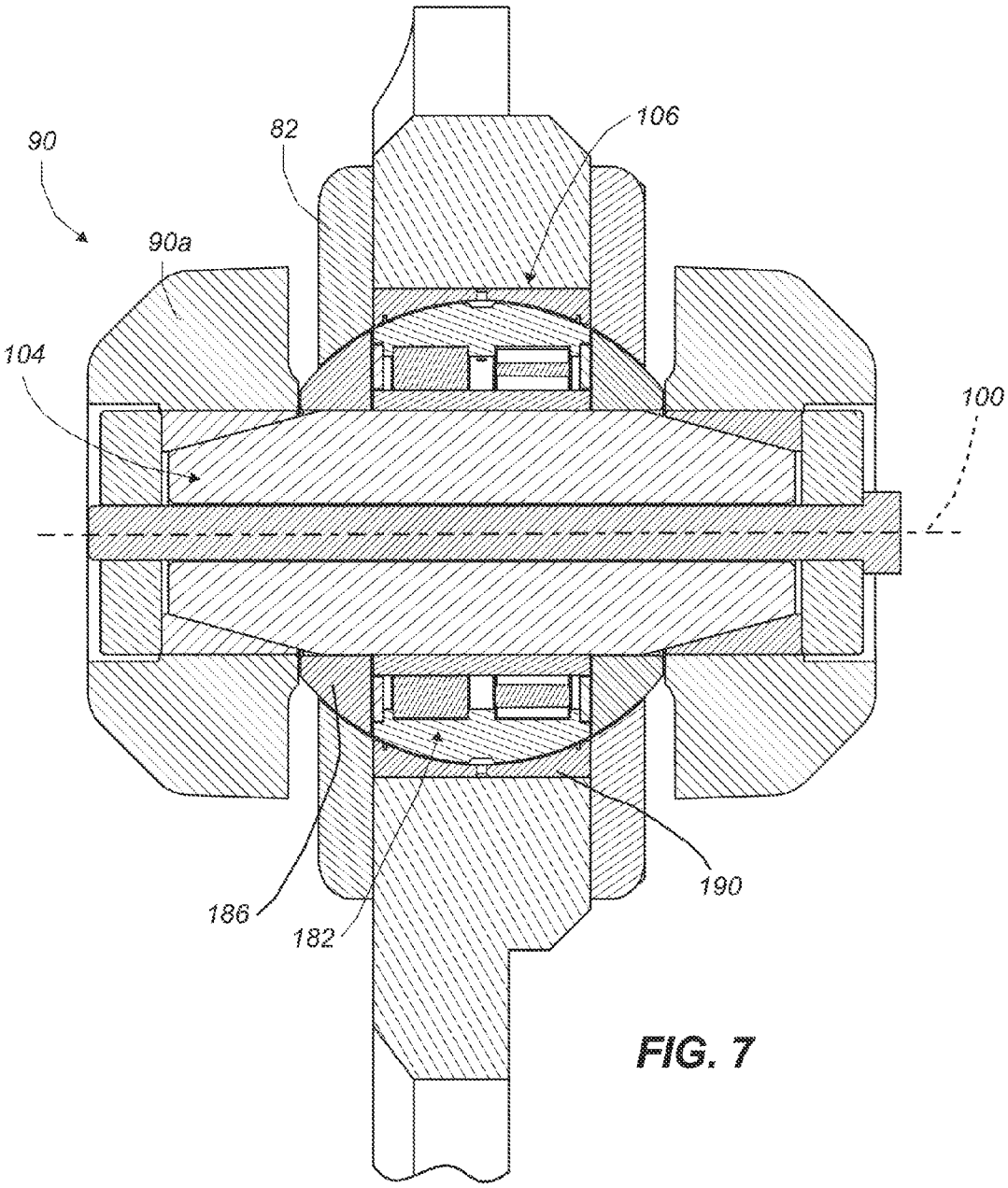
FIG. 7 is a cross-section view of a portion of the bail of FIG. 5 taken along line 7-7.

Referring to FIG. 7, the second end 90*b* of the first arm 90 is pivotably coupled to one of the trunnions 82 by a pin 104 that is supported by a spherical bearing 106. As used herein, the term "pivotable" and its variants refers to a member that is configured to rotate about an axis and is also configured to permit deflection or movement of the member in a direction that is perpendicular to the axis. In the illustrated embodiment, the spherical bearing 106 includes a cylindrical roller bearing 182 encapsulated within a spherical bushing 186, and the spherical bushing 186 is pivotable relative to a housing 190. In other embodiments, the spherical bearing includes only a spherical bushing (i.e., without the cylindrical roller bearing encapsulated therein; see description below regarding spherical bearing 138 and FIG. 11). In still other embodiments, the spherical bearing includes a conventional spherical bearing in which a plurality of roller elements, a cup, and a cone have a spherical nature. Therefore, the pin 104 is substantially rotatable about the arm axis 100. However, the spherical bearing 106 permits misalignment of the pin 104, or movement of the pin 104 in a direction perpendicular to the arm axis 100. That is, in addition to rotating about the arm axis 100, the pin 104 is also pivotable away from the arm axis 100. This additional degree of freedom permits the first arm 90 deflect laterally. It is understood that the second end 94*b* of the second arm 94 is coupled to the other of the trunnions 82 in a similar manner.

As best shown in FIGS. 5 and 6, the cross-member 98 defines a first side 108 (FIG. 5), a second side 110 (FIG. 6), an upper edge 114, and a lower edge 118, and the cross-member 98 includes a mounting block 122, a first end 124, and a second end 126. The mounting block 122 is positioned laterally between the shoulders 102 of the arms 90, 94. The mounting block 122 is also positioned between the upper edge 114 and the lower edge 118 of the cross-member 98. The cross-member 98 and the mounting block 122 are substantially pivotable about a cross-member axis, or pivot axis 130, extending between the second ends 90*b*, 94*b* of the arms 90, 94 and laterally spaced from the lower edge 118. In the illustrated embodiment, the mounting block 122 intersects the pivot axis 130. Also, in the illustrated embodiment, the pivot axis 130 is substantially parallel to the arm axis 100 and is positioned between the arm axis 100 and the upper edge 114. The pivot axis 130 is also positioned between the upper edge 114 and the lower edge 118 of the cross-member 98.

Figure 8:
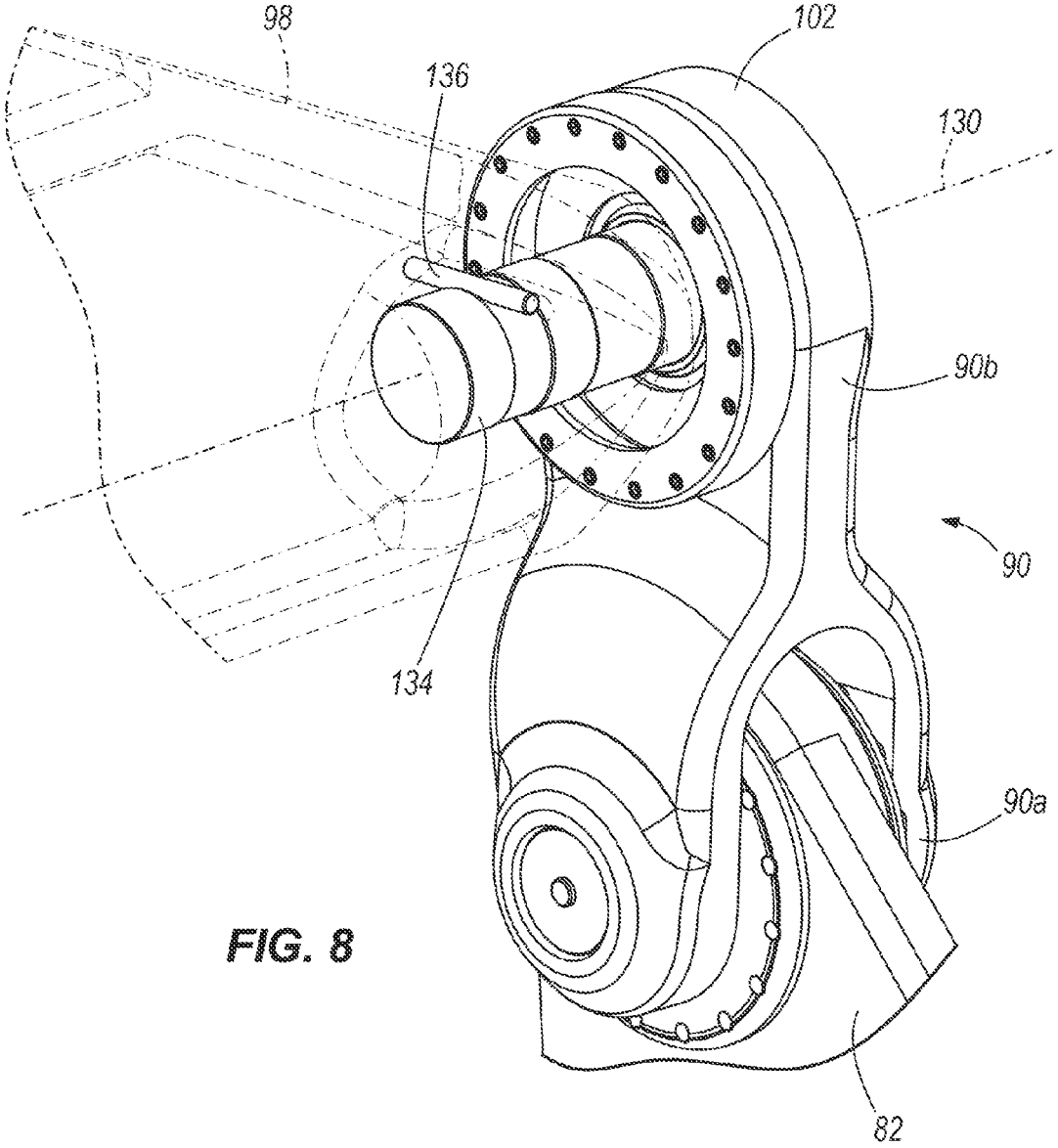
FIG. 8 is an enlarged perspective view of the bail of FIG. 5.
Figure 9:
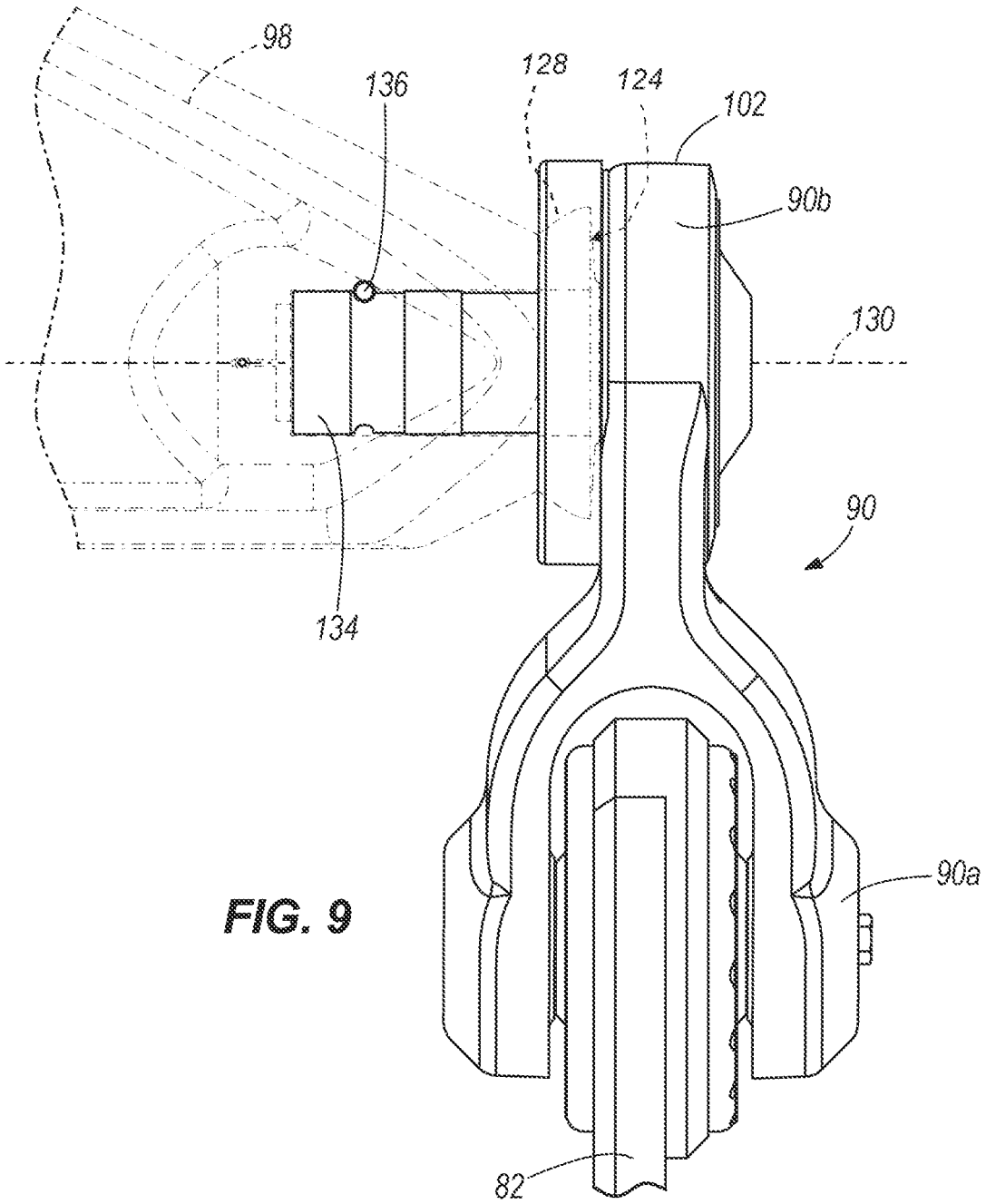
FIG. 9 is an enlarged side view of the bail of FIG. 5.
Figure 10:
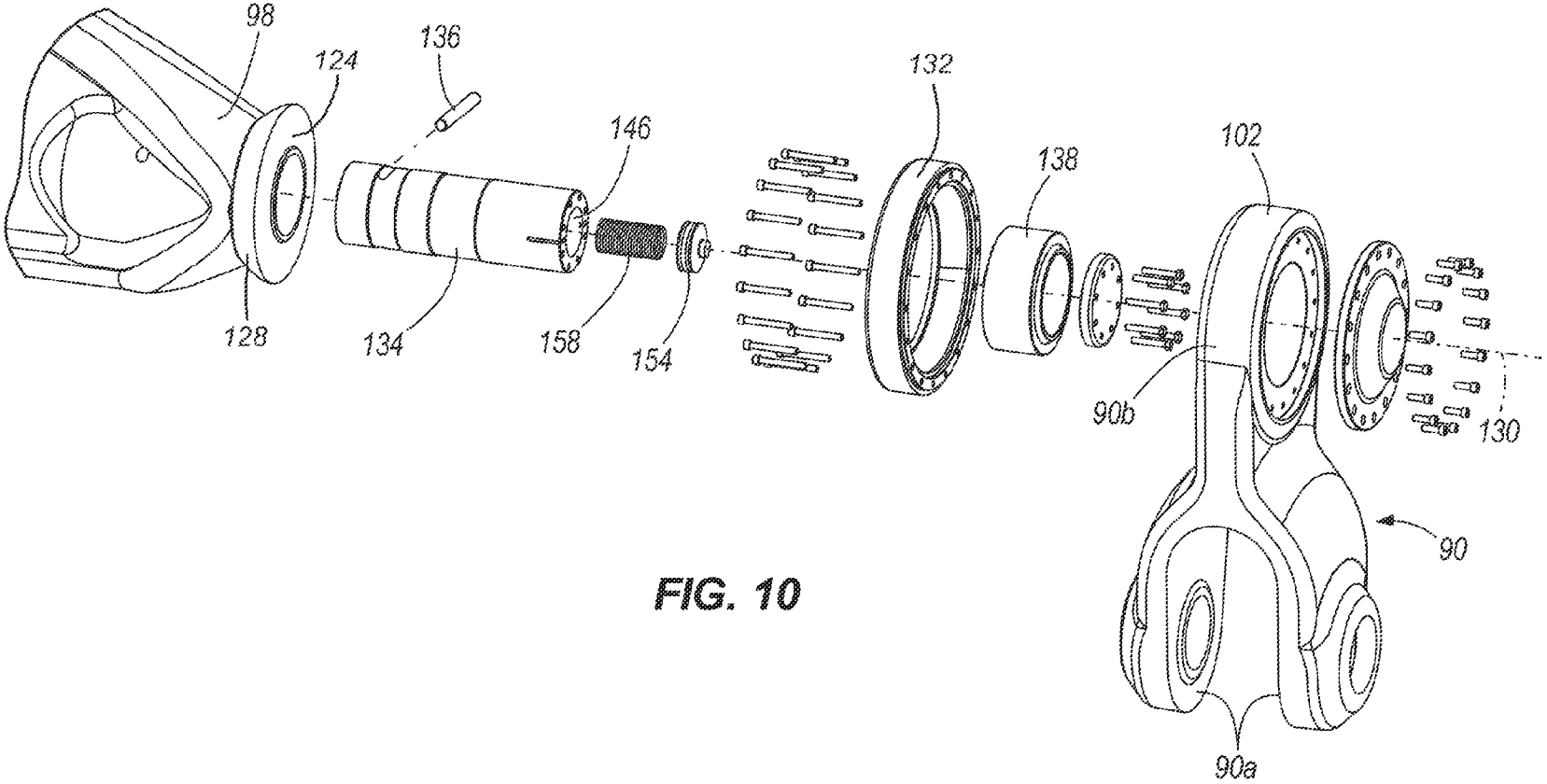
FIG. 10 is an exploded perspective view of a portion of the bail of FIG. 5.
Figure 11:
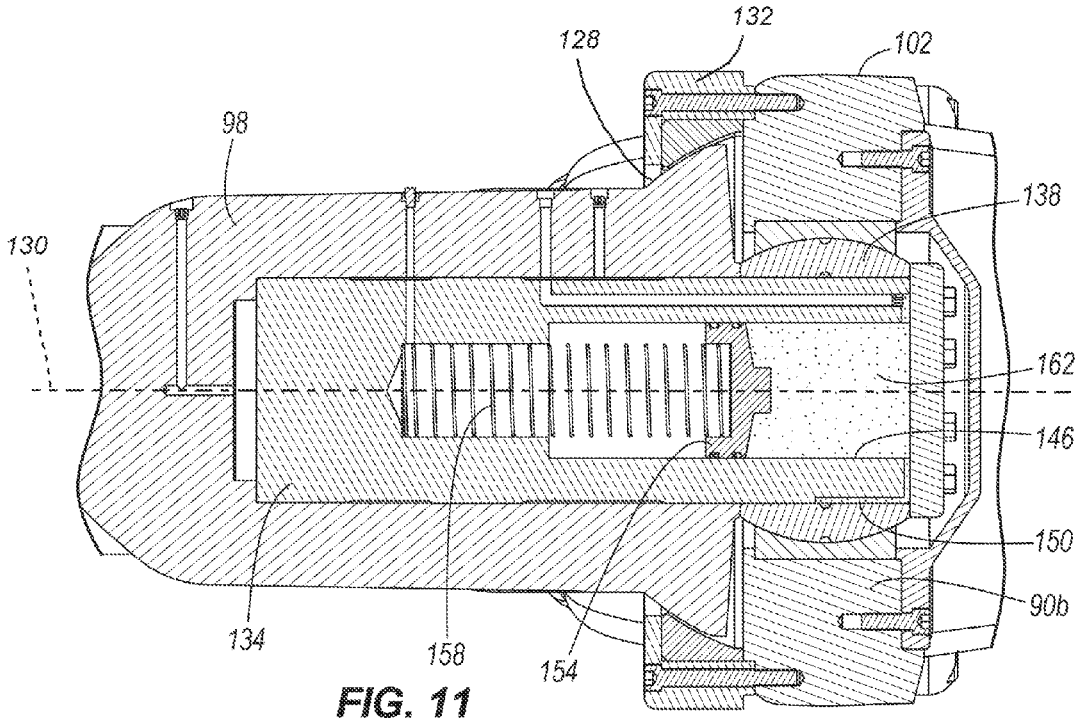
FIG. 11 is a cross-section view of a portion of the bail of FIG. 5 taken along line 11-11.

Referring to FIGS. 8 and 9, the first end 124 of the cross-member 98 is pivotably coupled to the first arm 90 by a pin 134 that is rotationally secured by a locking dowel 136. In addition, as best shown in FIGS. 10 and 11, the first end 124 of the cross-member 98 includes a tapered surface 128. The first end 124 is coupled to the second end 90*b* of the first arm 90 by a collar 132 that is secured to the second end 90*b*. Clearance between the collar 132, the tapered surface 128, and the second end 90*b* permits the tapered surface 128 to pivot and deflect laterally away from the pivot axis 130. The collar 132 also provides protection against contamination of the spherical bearing 138. Although not shown, it is understood that the second end 126 of the cross-member 98 is coupled to the second arm 94 in a substantially identical manner.

Referring now to FIGS. 10 and 11, the pin 134 is pivotably supported by a spherical bushing or bearing 138. In the illustrated embodiment, the spherical bearing 138 is formed as a spherical bushing. In other embodiments, the spherical bearing includes a cylindrical roller bearing encapsulated within a spherical bushing, and the spherical bushing is pivotable relative to a housing (see description above regarding spherical bearing 106 and FIG. 7). In still other embodiments, the spherical bearing includes a conventional spherical bearing in which a plurality of roller elements, a cup, and a cone have a spherical nature. The pin 134 is substantially rotatable about the pivot axis 130, but the pin 134 and the cross-member 98 are also capable of being laterally deflected in a direction perpendicular to the pivot axis 130. That is, in addition to rotating about the pivot axis 130, the pin 134 is also pivotable away from the pivot axis 130.

As shown in FIG. 11, the pin 134 includes an internal, self-contained lubrication system. The pin 134 includes a bore 146, at least one port 150, a plunger 154 positioned within the bore 146, and a spring 158 positioned within the bore 146 and biasing the plunger 154. On one side of the plunger 154, the bore 146 is partially filled with a lubricative fluid, such as grease 162, and is in fluid communication with the port 150. The spring force causes the plunger 154 to apply pressure on the grease 162, forcing grease 162 into the port 150. The grease 162 travels through the port 150 to lubricate the spherical bearing 138. The plunger 154 distributes grease 162 to the bearing 138 at a constant rate, reducing the amount of maintenance and greasing operations required by the operator. It is understood that the cross-member 98 is coupled to the second arm 94 by a pin (not shown) including a similar lubrication system.

Figure 12:
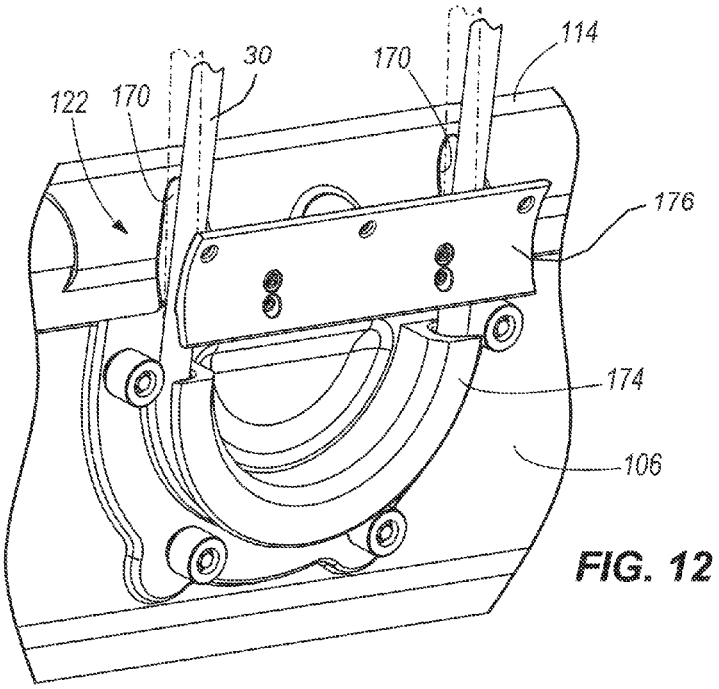
FIG. 12 is a perspective view of a first side of a cross-member.
Figure 13:
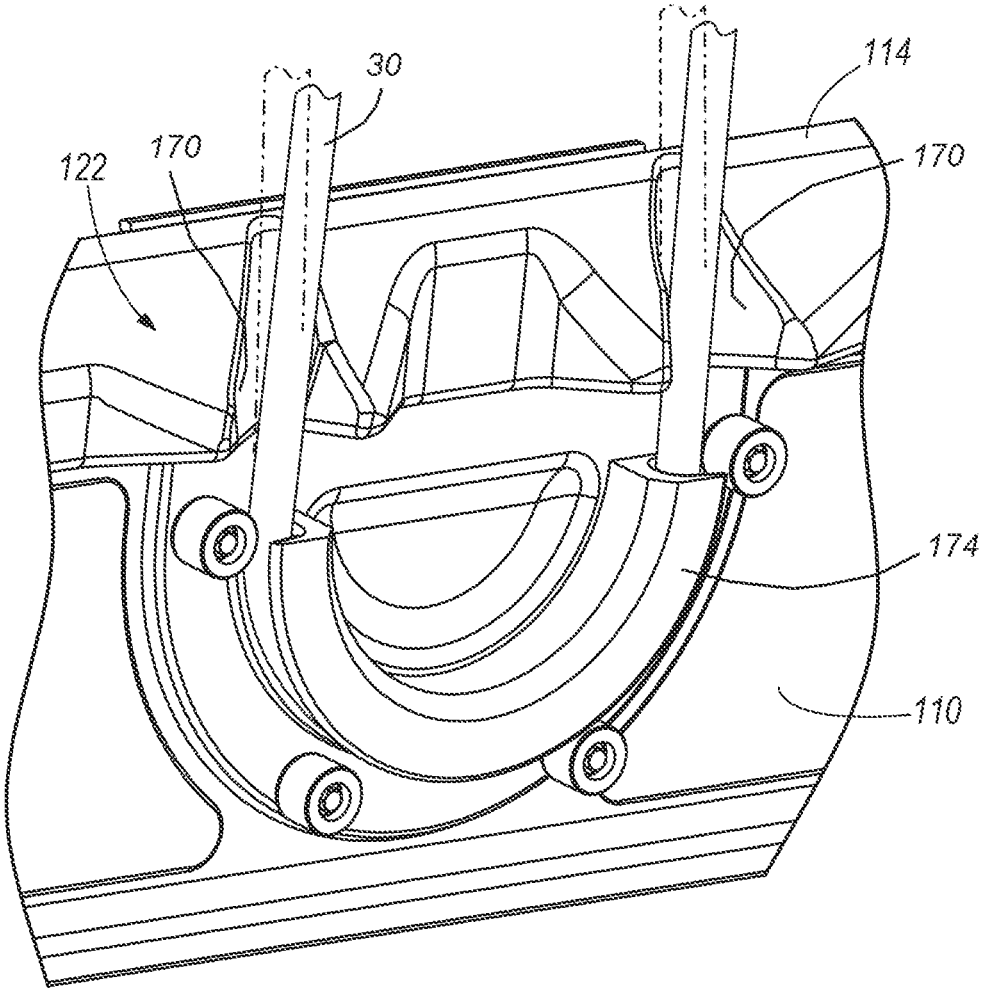
FIG. 13 is a perspective view of a second side of the cross-member of FIG. 12

Referring now to FIG. 12, the mounting block 122 includes a pair of rope guide slots 170 and a partial sheave 174 positioned on the first side 108 of the cross-member 98. Each rope guide slot 170 has a conical cross-section and angles inwardly toward the other rope guide slot 170. The rope 30 passing over the boom sheave 46 (FIG. 1) passes into one of the slots 170, wraps around the partial sheave 174, and passes out of the other slot 170 to secure the rope 30 to the cross-member 98. In the illustrated embodiment, the mounting block 122 also includes a stop surface 176 that mates with the boom sheave 46 when the bail 66 is lifted into contact with the boom sheave 46. As shown in FIG. 13, the mounting block 122 on the second side 110 of the cross-member 98 also includes a pair of rope guide slots 170 and a partial sheave 174 for receiving a second rope 30.

The conical cross-section of the rope guide slots 170 permits portions of the rope 30 to move toward or away from each other as the dipper assembly 26 is raised and lowered due to the rope 30 being reeled in or paid out. That is, the conical cross-sections are wider near the upper edge 114 of the cross-member 98 to accommodate various fleet angles, or the angle between the portions of the rope 30 received in the rope guide slots 170. For instance, as shown in FIGS. 12 and 13, when the dipper assembly 26 is in a lowered position, the rope portions 30 may be substantially straight (solid lines in FIGS. 12 and 13). As the dipper assembly 26 is raised toward the boom sheave 46, the rope portions 30 move closer together (broken lines in FIGS. 12 and 13). Because the rope guide slots 170 are wider near the upper edge 114 of the cross-member 98, the rope portions 30 can move closer together. The conical cross-section of the rope guide slots 170 prevents pinching and therefore reduces wear on the rope 30.

During operation, the dipper assembly 26 is hoisted by the rope 30 through a bank of material. Variations in the density of the bank and other factors may cause the dipper assembly 26 to deflect laterally, inducing reaction loads on the dipper assembly 26 and the bail 66 in multiple directions. The spherical bearings 138 permit misalignment of the pins 134, allowing the first arm 90 and the second arm 94 to deflect under the reaction loads. By making the bail 66 more tolerant of deflections, the spherical bearings 138 reduce the stress on the cross-member 98, the pins 134, and the arms 90, 94. In addition, the plunger 154 and the spring 158 provide regular lubrication to further improve the working life of the bail 66.

Figure 14:
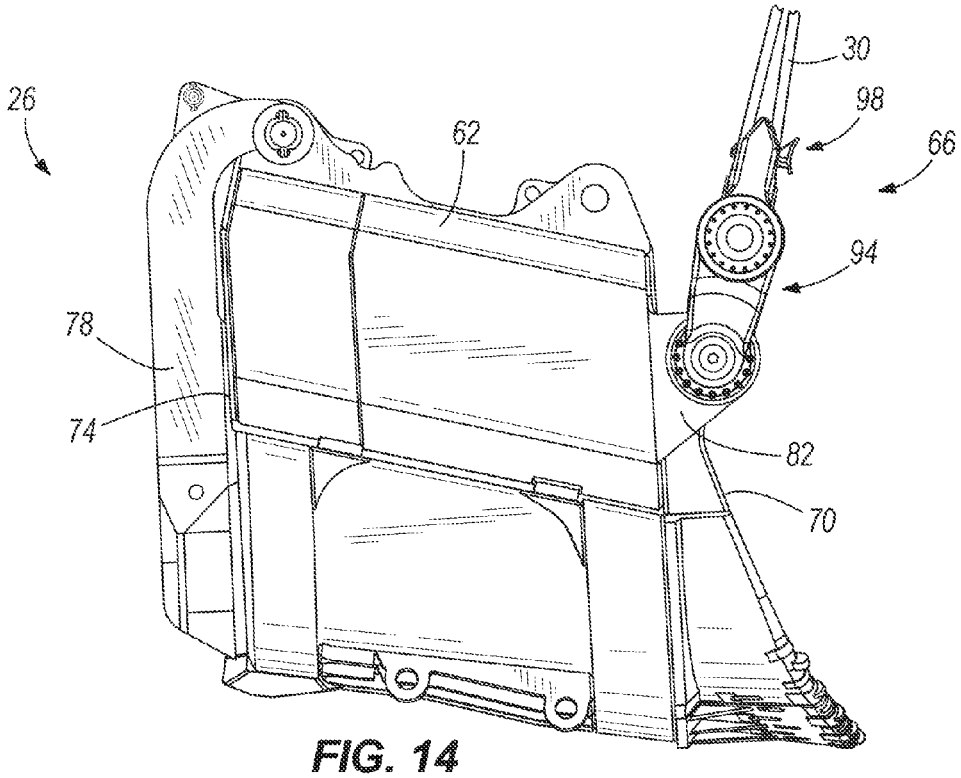
FIG. 14 is a side view of a dipper assembly with a hoist rope in a taut state.
Figure 15:
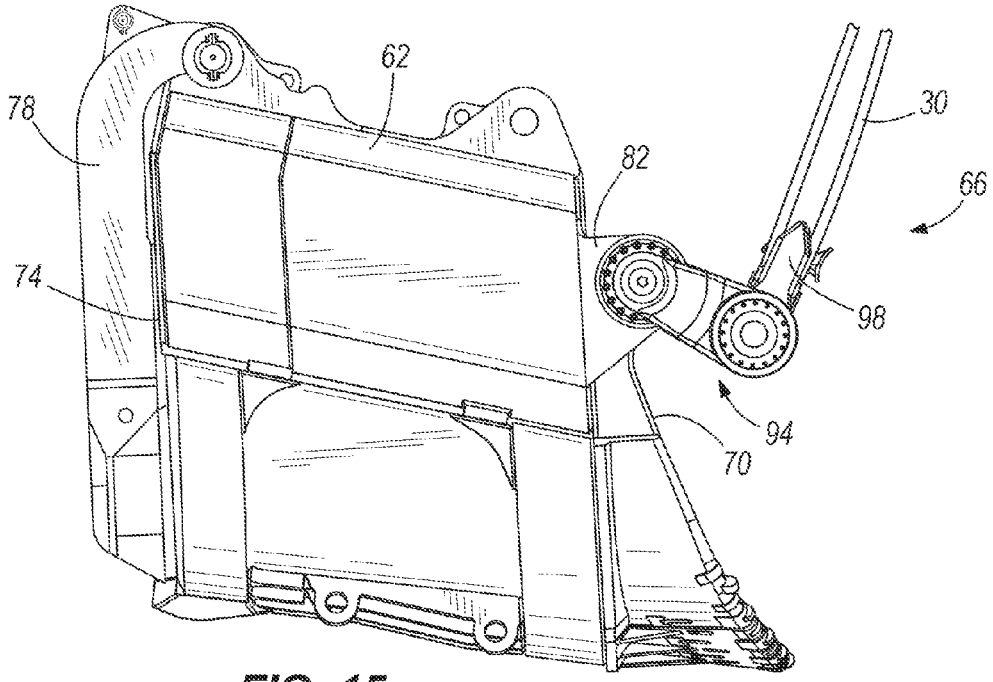
FIG. 15 is a side view of the dipper assembly of FIG. 14 with the hoist rope in a slack state.

As shown in FIG. 2, the bail 66 maintains digging force in the dipper assembly 26 by maintaining alignment between the rope 30 and a tangent of the boom sheave 46. The compact design of the bail 66 reduces the length of the components between the rope 30 and the dipper body 62 and improves dig and dump heights without sacrificing digging force. The bail 66 also maintains the rope 30 in a substantially tangential relationship with the boom sheave 46 even during slack conditions. As shown in FIG. 14, when the rope 30 is taut, the cross-member 98 and the rope 30 remain in tension and substantially aligned with a tangent of the boom sheave 46 (FIG. 2), independent of the position of the dipper assembly 26. FIG. 15 illustrates the behavior of the bail 66 when the rope 30 is slack. Whereas a conventional bail would "flop" into a slack position to pull the rope away from tangential alignment with the boom sheave and induce bending in the ropes, the cross-member 98 rotates independent of the arms 90, 94 to avoid bending or pinching of the rope 30. This reduces wear on the rope 30.

Thus, the invention provides, among other things, a bail for a rope shovel. Various features and advantages of the invention are set forth in the following claims.

What is claimed is:

1. A bail for a rope shovel, the shovel including a hoist rope and a dipper, the bail comprising:

a pair of arms, each arm including a first end and a second end, the first end configured to be pivotably coupled to the dipper;

a cross-member extending between the pair of arms and being pivotably coupled to the second end of each of the arms, the cross-member including a mounting block for receiving the hoist rope;

a pair of pins extending between the cross-member and the arms, each pin extending between the cross-member and the second end of one of the arms; and a pair of spherical bearings, each spherical bearing receiving at least a portion of one of the pins and supporting the pin for pivotal movement relative to the respective arm.

2. The bail of claim 1, wherein the pair of spherical bearings is a pair of first spherical bearings, and further comprising a pair of second spherical bearings, wherein the first end of each of the arms is pivotably coupled to the dipper by one of the second spherical bearings.

3. The bail of claim 1, wherein the cross-member defines an upper edge and a lower edge, wherein the mounting block is positioned between the upper edge and the lower edge.

4. The bail of claim 3, wherein the cross-member pivots about a cross-member axis that is laterally spaced from the lower edge of the cross-member and positioned between the upper edge and the lower edge.

5. The bail of claim 1, wherein each arm defines a shoulder, wherein the mounting block is positioned laterally between the shoulders.

6. The bail of claim 1, wherein each spherical bearing includes a spherical bushing positioned in the second end of the respective arm and supporting at least a portion of the respective pin for pivotal movement relative to the arm.

7. The bail of claim 1, wherein each pin includes a hollow bore, a plunger, and a spring, the bore being at least partially filled with lubricative fluid for lubricating the pin and the associated spherical bearing, the spring biasing the plunger against the lubricative fluid to apply pressure on the lubricative fluid.

8. The bail of claim 1, wherein the cross-member includes a first end pivotably coupled to one of the arms by a collar, the first end of the cross-member including a tapered surface that is moveable relative to the collar and the one arm in order to permit pivoting movement of the cross-member.

9. The bail of claim 1, wherein the mounting block includes a pair of rope guide slots for receiving the hoist rope, each rope guide slot having a conical cross-section.

10. The bail of claim 1, wherein the length of the arms is selected to optimize the clearance between the dipper and the cross-member.

11. A dipper assembly for a rope shovel, the shovel including a hoist rope extending over a boom and coupled to the dipper assembly to raise and lower the dipper assembly, the dipper assembly comprising:

a dipper including a dipper body defining a material receiving end and a material discharging end, the dipper further including a dipper door pivotably coupled to the dipper body and positioned proximate the material discharging end to selectively close the material discharging end;

a pair of arms coupled to opposing sides of the dipper body, each arm including a first end coupled to the dipper body and a second end;

a cross-member pivotably coupled to the second end of each arm, the cross-member including a mounting block for receiving the hoist rope;

a pair of pins extending between the cross-member and the arms, each pin extending between the cross-member and the second end of one of the arms; and a pair of spherical bearings, each spherical bearing receiving at least a portion of one of the pins and supporting the pin for pivotal movement relative to the respective arm.

12. The dipper assembly of claim 11, wherein the pair of pins is a first pair of pins and the pair of spherical bearings is a first pair of spherical bearings, wherein the first end of one of the arms is coupled to the dipper body by a second pin that is pivotably supported by a second spherical bearing.

13. The dipper assembly of claim 12, wherein the second spherical bearing includes a spherical bushing and a cylindrical roller bearing encapsulated within the spherical bushing, wherein the spherical bushing is pivotable relative to the dipper.

14. The dipper assembly of claim 11, wherein the cross-member defines an upper edge and a lower edge, wherein the mounting block is positioned between the upper edge and the lower edge.

15. The dipper assembly of claim 14, wherein the pair of arms are parallel such that the first ends of the arms pivot about an arm axis, wherein the cross-member pivots about a cross-member axis that is substantially parallel to the arm axis and positioned between the upper edge of the cross-member and the arm axis.

16. The dipper assembly of claim 11, wherein the second end of each arm defines a shoulder, the mounting block being positioned laterally between the shoulders.

17. The dipper assembly of claim 11, wherein each spherical bearing includes a spherical bushing positioned in the second end of the one arm and supporting at least a portion of the respective pin for pivotal movement relative to the arm.

18. The dipper assembly of claim 11, wherein each pin includes a hollow bore, a plunger, and a spring, the bore being at least partially filled with lubricative fluid for lubricating the pin and the associated spherical bearing, the spring biasing the plunger against the lubricative fluid to apply pressure on the lubricative fluid.

19. The dipper assembly of claim 11, wherein the mounting block includes a pair of rope guide slots for receiving the hoist rope, each rope guide slot having a conical cross-section.

20. A bail for a rope shovel, the shovel including a hoist rope extending over a boom and a dipper, the bail comprising:

a first arm including a first end and a second end, the first end being pivotably coupled to the dipper;

a second arm substantially parallel to the first arm and including a first end and a second end, the first end being pivotably coupled to the dipper;

an elongated cross-member including a first end, a second end, a pivot axis extending between the first end and the second end, and a mounting block receiving a portion of the hoist rope, the first end of the cross-member coupled to the second end of first arm, the second end of the cross-member coupled to the second end of the second arm; and a pair of spherical bearings, each spherical bearing supporting the cross-member for pivoting movement about the pivot axis relative to one of the first arm and the second arm.

21. The bail of claim 20, wherein the first end of the cross-member is pivotably coupled to the second end of the first arm by a pin, the pin being pivotably supported relative to one of the arms by one of the spherical bearings.

22. The bail of claim 21, wherein the pin includes a hollow bore, a plunger, and a spring, the bore being at least partially filled with lubricative fluid for lubricating the pin and the one spherical bearing, the spring biasing the plunger against the lubricative fluid to apply pressure on the lubricative fluid.

23. The bail of claim 20, wherein the cross-member defines an upper edge and a lower edge, wherein the pivot axis is laterally spaced from the lower edge.

24. The bail of claim 23, wherein the first end of the first arm and the first end of the second arm is pivotable about an arm axis, wherein the pivot axis is substantially parallel to the arm axis and positioned between the upper edge of the cross-member and the arm axis.

25. The bail of claim 20, wherein the mounting block includes a pair of rope guide slots for receiving the hoist rope, each rope guide slot having a conical cross-section.

26. The bail of claim 20, wherein the first end of the first arm is coupled to the dipper by a pin that is pivotably supported by a third spherical bearing, and the first end of the second arm is coupled to the dipper by a pin that is pivotably supported by a fourth spherical bearing.

27. The bail of claim 26, wherein the spherical bearing that pivotably supports the pin coupling the first arm to the dipper includes a spherical bushing and a cylindrical roller bearing encapsulated within the spherical bushing, wherein the spherical bushing is pivotable relative to the dipper.

28. The bail of claim 20, wherein the pair of spherical bearings includes a first spherical bushing positioned in the second end of the first arm and a second spherical bushing positioned in the second end of the second arm, the first spherical bushing supporting the first end of the cross-member for pivoting movement, the second spherical bushing supporting the second end of the cross-member for pivoting movement.

* * * * *